US010667969B2

(12) United States Patent
Farricielli et al.

(10) Patent No.: US 10,667,969 B2
(45) Date of Patent: Jun. 2, 2020

(54) ERGONOMICALLY DESIGNED SEATING APPARATUS

(71) Applicants: Susan Farricielli, Branford, CT (US); Eric Bovell, Branford, CT (US)

(72) Inventors: Susan Farricielli, Branford, CT (US); Eric Bovell, Branford, CT (US)

(73) Assignee: Kinetic Innovative Seating System LLC, Branford, CT (US)

( * ) Notice: Subject to any disclaimer, the term of this patent is extended or adjusted under 35 U.S.C. 154(b) by 36 days.

(21) Appl. No.: 16/057,349

(22) Filed: Aug. 7, 2018

(65) Prior Publication Data

US 2019/0216662 A1 Jul. 18, 2019

Related U.S. Application Data

(60) Provisional application No. 62/617,842, filed on Jan. 16, 2018.

(51) Int. Cl.

| | |
|---|---|
| ***A61G 5/10*** | (2006.01) |
| ***A61G 5/12*** | (2006.01) |
| ***A47C 7/46*** | (2006.01) |

(52) U.S. Cl.

CPC ..... *A61G 5/1067* (2013.01); *A47C 7/46* (2013.01); *A61G 5/1062* (2013.01); *A61G 5/1091* (2016.11); *A61G 5/122* (2016.11); *A61G 5/124* (2016.11); *A61G 5/1081* (2016.11); *Y10S 297/04* (2013.01)

(58) Field of Classification Search

CPC .. A61G 5/1056; A61G 5/1062; A61G 5/1067; A61G 5/1081; A61G 5/1091; A61G 5/12; A61G 5/122; A61G 5/124; A47C 1/06; A47C 7/46; A47C 7/004; Y10S 297/04

See application file for complete search history.

(56) References Cited

U.S. PATENT DOCUMENTS 2,859,799 A 11/1958 Moore
3,142,351 A * 7/1964 Green ..... A61G 5/0816 180/8.2

(Continued)

FOREIGN PATENT DOCUMENTS

EP 1013198 A2 6/2000
EP 1319355 A2 * 6/2003 ..... A47C 7/448

*Primary Examiner* — Ryan D Kwiecinski
(74) *Attorney, Agent, or Firm* — St. Onge Steward Johnston & Reens, LLC

(57) ABSTRACT

An ergonomically designed seating apparatus having a seat and a backrest. The seat having a seat frame securable to a chassis, a seat support pivotally connected to the seat frame, and at least one first resilient member positioned between the seat frame and the seat support permitting resilient relative pivotal tilting between them. The backrest having a back frame securable to the chassis, a lumbar support connected to the back frame, a back support pivotally connected to the lumbar support, at least one second resilient member positioned along surfaces of the lumbar support and the back support permitting resilient relative pivotal tilting between them, at least one pivot arm connected to the back support configured to limit the pivotal range of motion of the back support, and at least one pivot block connected to the lumbar support configured to interact with the at least one pivot arm.

20 Claims, 9 Drawing Sheets

(56) References Cited

U.S. PATENT DOCUMENTS 3,280,410 A 10/1966 Propst et al.
3,917,312 A 11/1975 Rodaway
3,990,745 A 11/1976 Rodaway
4,362,311 A 12/1982 Bergman
4,405,142 A 9/1983 Whetstine
4,574,901 A 3/1986 Joyner
4,629,246 A 12/1986 Fulton
4,641,848 A 2/1987 Ayers
4,832,402 A 5/1989 Zund
5,004,259 A 4/1991 Ayers et al.
5,035,467 A 7/1991 Axelson et al.
5,074,620 A 12/1991 Jay et al.
5,076,602 A 12/1991 Robertson et al.
5,102,195 A 4/1992 Axelson et al.
5,112,076 A 5/1992 Wilson
5,524,971 A 6/1996 Jay et al.
5,551,756 A 9/1996 Gurasich et al.
5,857,749 A 1/1999 DeBellis et al.
5,904,398 A * 5/1999 Farricielli ..... A61G 5/00 297/296
5,954,402 A * 9/1999 McInturff ..... A61G 5/1062 297/440.22
5,959,965 A 9/1999 Ohkubo et al.
5,976,097 A 11/1999 Jensen
5,997,021 A 12/1999 Robinson et al.
6,032,975 A 3/2000 Hanson et al.
6,073,951 A 6/2000 Jindra et al.
6,095,611 A 8/2000 Bar et al.
6,257,664 B1 7/2001 Chew et al.
6,296,265 B1 10/2001 Lovins
6,322,145 B1 11/2001 Melgarejo et al.
6,352,307 B1 * 3/2002 Engman ..... A61G 5/1059 297/284.1
6,425,635 B1 7/2002 Pulver
6,447,064 B1 9/2002 Mundy et al.
6,460,933 B1 10/2002 Bors et al.
6,474,743 B1 11/2002 Harker et al.
6,488,332 B1 12/2002 Markwald
6,527,340 B1 3/2003 Finch et al.
6,547,206 B1 4/2003 Dickie
6,688,693 B2 2/2004 Christofferson et al.
6,705,678 B1 3/2004 Albright et al.
6,866,340 B1 3/2005 Robertshaw
6,991,292 B2 1/2006 Kasten
7,008,017 B1 3/2006 Wegener
7,014,204 B2 3/2006 Meyers et al.
7,216,935 B2 5/2007 Wegener
7,234,777 B2 6/2007 Schweikarth et al.
7,243,935 B2 7/2007 Beumer
7,338,125 B2 3/2008 Grabowski
7,434,881 B1 10/2008 Wegener
7,455,362 B2 * 11/2008 Hanson ..... A61G 5/10 297/320
7,845,665 B2 12/2010 Borisoff
7,857,394 B2 12/2010 Whelan et al.
8,070,230 B2 12/2011 Krob et al.
8,075,057 B2 12/2011 Reingewirtz et al.
8,167,371 B2 5/2012 Underwood
8,282,166 B2 10/2012 Piretti
8,419,133 B2 4/2013 Holt et al.
8,517,469 B1 * 8/2013 Hetzel ..... A61G 5/1067 280/250.1
8,523,214 B2 9/2013 Johansson et al.
8,864,230 B2 10/2014 Augustat
8,894,150 B2 11/2014 Piretti
8,991,926 B2 3/2015 Johansson
8,991,933 B2 3/2015 Johansson
8,998,321 B2 4/2015 Piretti
9,004,597 B2 4/2015 Battey et al.
9,049,935 B2 6/2015 Battey et al.
9,102,250 B2 8/2015 Seibold
9,138,061 B1 9/2015 Eisenberg
9,247,817 B2 2/2016 Grace
2002/0056970 A1 5/2002 Groth
2003/0030318 A1 * 2/2003 Christofferson ..... A47C 7/46 297/452.34
2003/0102706 A1 * 6/2003 Float ..... A47C 7/42 297/440.2
2003/0127896 A1 * 7/2003 Deinnen ..... A47C 7/14 297/301.1
2005/0116525 A1 6/2005 Holcomb et al.
2006/0175884 A1 * 8/2006 Jenkins ..... A47C 3/026 297/300.4
2007/0108829 A1 5/2007 Lehn et al.
2007/0236066 A1 * 10/2007 Sanchez ..... A47C 7/402 297/353
2010/0276974 A1 * 11/2010 Huttenhuis ..... A47C 7/42 297/284.3

* cited by examiner

ERGONOMICALLY DESIGNED SEATING APPARATUS

FIELD OF THE INVENTION

The present invention relates to a seating apparatus. Particularly, the invention relates to a seat and back support for a frame or seating chassis that is ergonomically designed to provide postural support and weight distribution through movement.

BACKGROUND OF THE INVENTION

The present invention is a seating apparatus designed to remedy some of the problems associated with prolonged sitting in an upright position, such as pain and discomfort. Manufacturers of office seats have recognized that pain and discomfort associated with prolonged, upright sitting can lead to high medical costs and reduced employee productivity.

Sitting discomfort has been widely investigated and has led to the development of seating systems that enhance the posture and comfort of individuals who sit for long periods of time. These seating systems offer ergonomic solutions based on the premise that comfort is not achieved from a single, static position, but required changes in posture through motion. However, these seating systems are complex, expensive to produce, and are not adaptable to a variety of seating chassis.

What is needed, therefore, is an ergonomically designed seating apparatus that is simple, cost-effective, and adaptable for use in a variety of seating chassis.

SUMMARY OF THE INVENTION

Accordingly, it is an object of the present invention to provide a seating apparatus that offers postural support for a user seated in an upright position.

A further object of the present invention is to provide a seat and a back support that may be used separately or together.

Another object of the present invention is to provide a seating apparatus that is adaptable for use in a variety of seating chassis, such as a wheelchair, automobile, stadium, auditorium, or airline seat.

Still another object of the present invention is to provide a seat that permits articulated movement of a user's pelvis while seated in an upright position.

A yet further object of the present invention is to provide a back support that permits flexibility of a user's spinal column while seating in an upright position.

These and other objects of the present invention are achieved by providing an ergonomically designed apparatus having a seat and a backrest. The seat includes a seat frame adapted to be secured to a chassis, a seat support pivotally connected to the seat frame such that the seat support is capable of pivotal tiling about a transverse horizontal axis relative to the seat frame, and at least one first resilient member positioned between the seat frame and the seat support permitting resilient relative pivotal tilting between the seat frame and the seat support. The backrest includes a back frame adapted to be secured to the chassis, the back frame includes two parallel bars; a lumbar support connected to the back frame at each of the two parallel bars; a back support pivotally connected to the lumbar support such that the back support is capable of pivotal tilting about a second transverse horizontal axis relative to the back frame, the two parallel bars aligning parallel to and on either side of the second transverse horizontal axis such that the second transverse horizontal axis is between the two parallel bars and the back support extends above the two parallel bars; and at least one second resilient member positioned along surfaces of the lumbar support and the back support permitting resilient relative pivotal tilting between the lumbar support and the back support. The back frame and the seat frame are connected to and removable from a wheelchair frame having at least three wheels, wherein a position of the second transverse horizontal axis is adjustable relative to the wheelchair frame from front to back.

In some embodiments, the seat frame includes at least one telescoping member arranged such that the seat frame is size-adjustable in at least one dimension. In other embodiments, the seat frame includes a plurality of telescoping members arranged such that the seat frame is size-adjustable in at least one dimension.

In some embodiments, the back frame includes at least one telescoping member connected to each of the two parallel bars and arranged such that the back frame is size-adjustable in at least one dimension. In other embodiments, the back frame includes a plurality of telescoping members connected to each of the two parallel bars and arranged such that the back frame is size-adjustable in at least one dimension.

In some embodiments, the back support includes at least one pivot arm extending below the second transverse horizontal axis configured to limit the pivotal range of motion of the back support. In other embodiments, the lumbar support includes at least one pivot block configured to interact with the at least one pivot arm.

In some embodiments, each of the seat support, the lumbar support, and the back support are formed of a rigid material, have a contoured shape ergonomically designed to correspond to the human body, and have a plurality of ventilation holes.

In an alternative embodiment of the present invention, an ergonomically designed seating apparatus having a seat and a backrest is provided. The seat includes a seat frame adapted to be secured to a chassis, a seat support pivotally connected to the seat frame such that the seat support is capable of pivotal tiling about a first transverse horizontal axis relative to the seat frame, and at least one first resilient member positioned between the seat frame and the seat support permitting resilient relative pivotal tilting between the seat frame and the seat support. The backrest includes a back frame adapted to be secured to the chassis, a lumbar support connected to the back frame, a back support pivotally connected to the lumbar support such that the back support is capable of pivotal tilting about a second transverse horizontal axis relative to the back frame, at least one second resilient member positioned along adjacent surfaces of the lumbar support and the back support permitting resilient relative pivotal tilting between the lumbar support and the back support, at least one pivot arm connected to the back support, and at least one pivot block connected to the lumbar support. The at least one pivot arm is configured to limit the pivotal range of motion of the back support, and the at least one pivot block is configured to interact with the at least one pivot arm.

In some embodiments, the seat frame includes at least one telescoping member arranged such that the seat frame is size-adjustable in at least one dimension.

In some embodiments, the back frame includes at least one telescoping member arranged such that the back frame is size-adjustable in at least one dimension.

In some embodiments, each of the seat support, the lumbar support, and the back support are formed of a rigid material, have a contoured shape ergonomically designed to correspond to the human body, and have a plurality of ventilation holes.

In another embodiment of the present invention, a wheelchair having a wheelchair chassis, a seat, and a backrest is provided. The seat includes a seat frame adapted to be secured to the wheelchair chassis, a seat support pivotally connected to the seat frame such that the seat support is capable of pivotal tiling about a first transverse horizontal axis relative to the seat frame, and at least one first resilient member positioned between the seat frame and the seat support permitting resilient relative pivotal tilting between the seat frame and the seat support. The backrest includes a back frame adapted to be secured to the wheelchair chassis, a lumbar support connected to the back frame, a back support pivotally connected to the lumbar support such that the back support is capable of pivotal tilting about a second transverse horizontal axis relative to the back frame, and at least one second resilient member positioned along adjacent surfaces of the lumbar support and the back support permitting resilient relative pivotal tilting between the lumbar support and the back support.

In some embodiments, the seat frame includes at least one telescoping member arranged such that the seat frame is size-adjustable in at least one dimension. In other embodiments, the seat frame includes a plurality of telescoping members arranged such that the seat frame is size-adjustable in at least one dimension.

In some embodiments, the back frame includes at least one telescoping member arranged such that the back frame is size-adjustable in at least one dimension. In other embodiments, the back frame includes a plurality of telescoping members arranged such that the back frame is size-adjustable in at least one dimension.

In some embodiments, the back support includes at least one pivot arm configured to limit the pivotal range of motion of the back support. In other embodiments, the lumbar support includes at least one pivot block configured to interact with the at least one pivot arm.

In some embodiments, each of the seat support, the lumbar support, and the back support are formed of a rigid material, have a contoured shape ergonomically designed to correspond to the human body, and have a plurality of ventilation holes.

The invention and its particular features and advantages will become more apparent from the following detailed description considered with reference to the accompanying drawings.

DETAILED DESCRIPTION OF THE INVENTION

Figure 1:
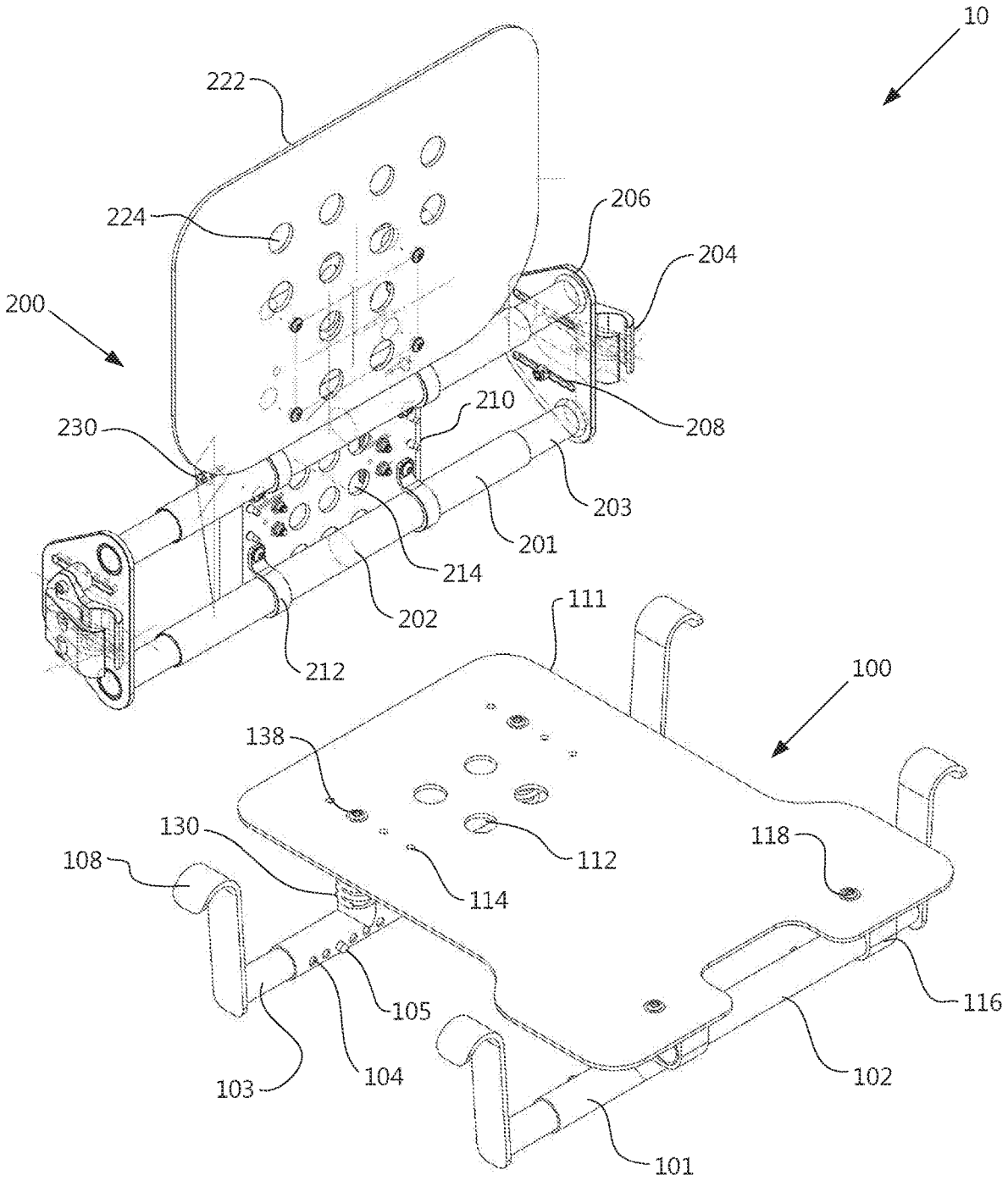
FIG. 1 is a front perspective view of a seating apparatus according to the present invention.
Figure 2:
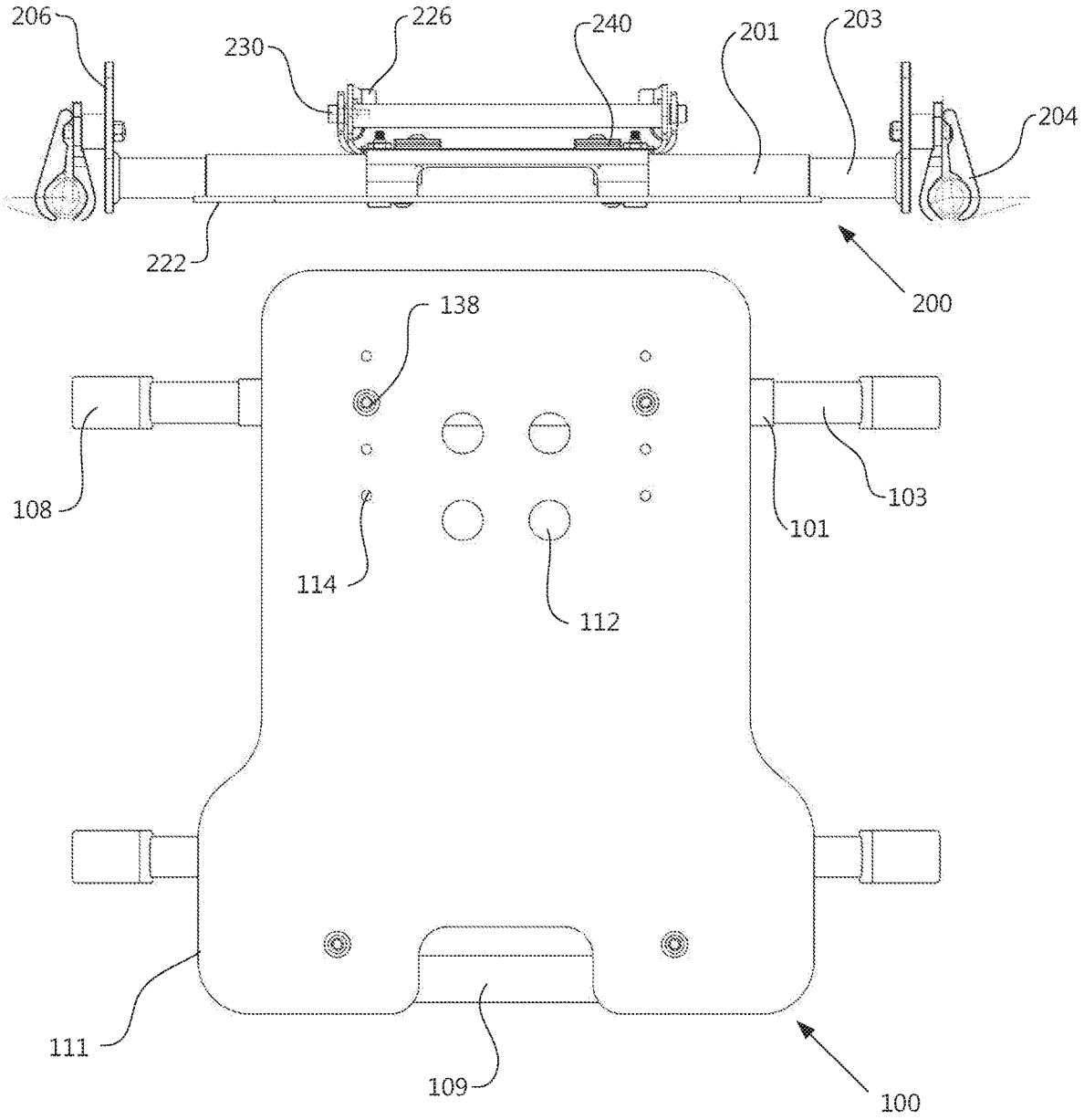
FIG. 2 is a top plan view of the seating apparatus of FIG. 1.

The present invention is directed to a seating apparatus that is a postural support for the human body and responds to the natural motions of a user seated in an upright position. The seating apparatus includes a seat and back support that can be utilized together or separately in a variety of seating chassis, such as a wheelchair, automobile, stadium, auditorium, or airline seat.

The seating apparatus provides postural support through mechanisms that allow movement of a user's body independent of the seating chassis. As the user moves, her weight in the back and pelvic areas are redistributed. Preferably, the seat redistributes the user's body weight and pressure in the seat by permitting movement up-and-down and side-to-side. Preferably, the backrest redistributes the user's body weight by providing resilience for the user to lean rearwards and back up again, and permitting flexibility of the user's spinal column.

Referring now to the drawings, wherein like reference numerals designate corresponding structures throughout the views. The following examples are presented to further illustrate and explain the present invention and should not be taken as limiting in any regard.

The figures show exemplary embodiments of the present invention. FIG. 1 shows a seating apparatus 10 having a seat 100 and a backrest 200. Preferably, the seat 100 and the backrest 200 are separate components that redistribute a user's weight independently of each other. In preferred embodiments, the seat 100 and the backrest 200 are separately mounted to the same seating chassis. In some embodiments, only the seat 100 is mounted to a seating chassis. In other embodiments, only the backrest 200 is mounted to a seating chassis.

Figure 3:
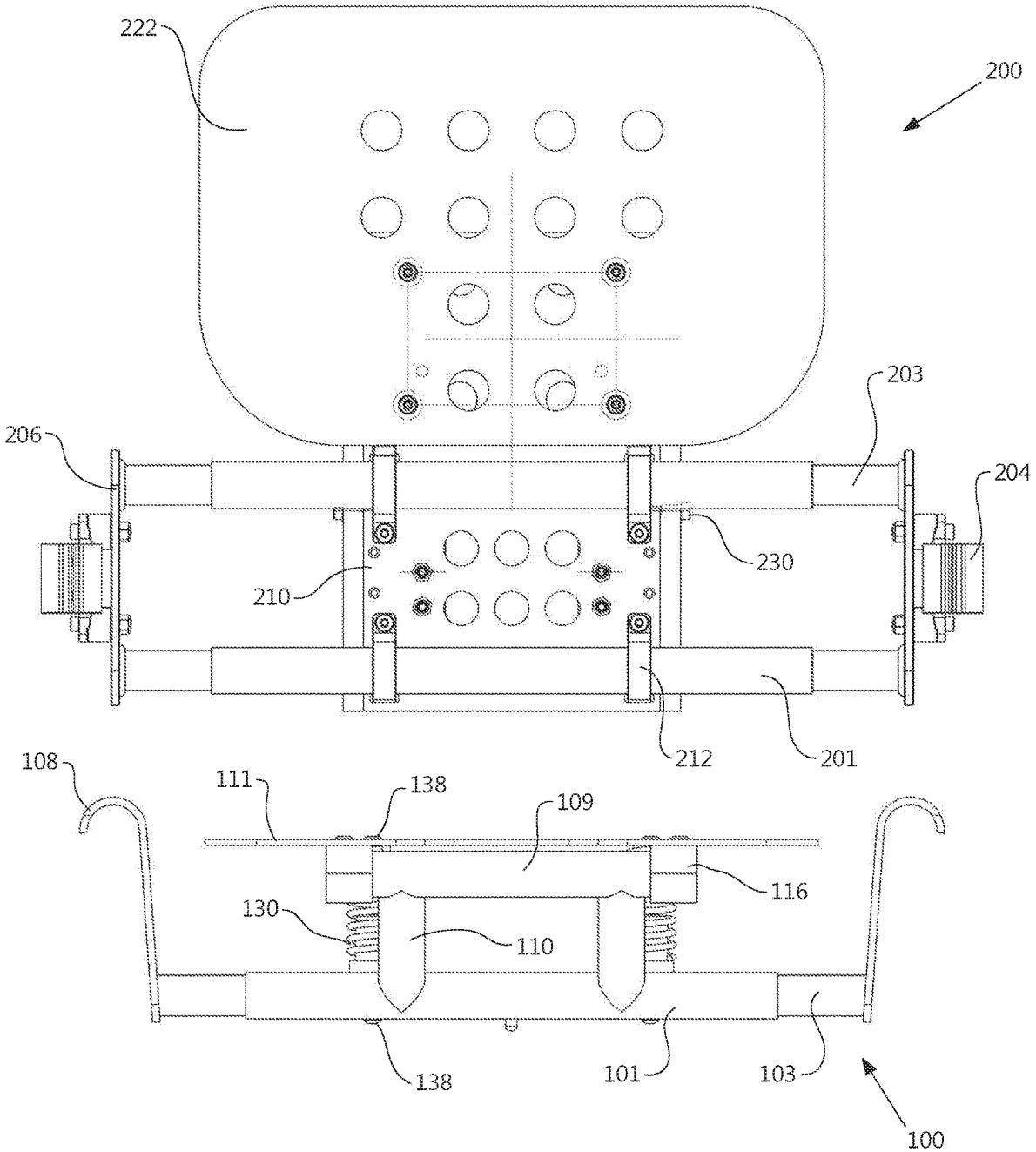
FIG. 3 is a front elevational view of the seating apparatus of FIG. 1.
Figure 4:
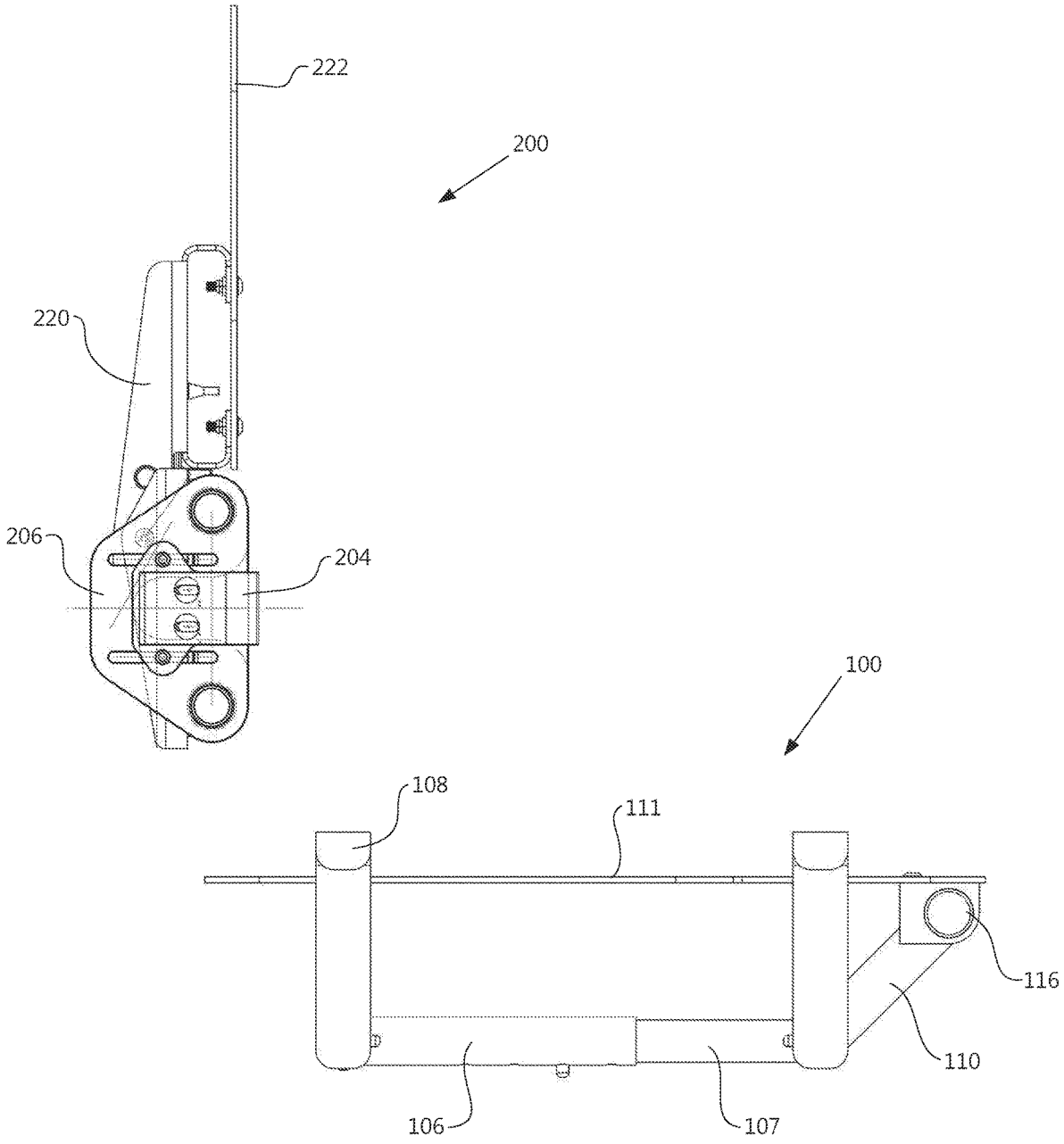
FIG. 4 is a side elevational view of the seating apparatus of FIG. 1.
Figure 8:
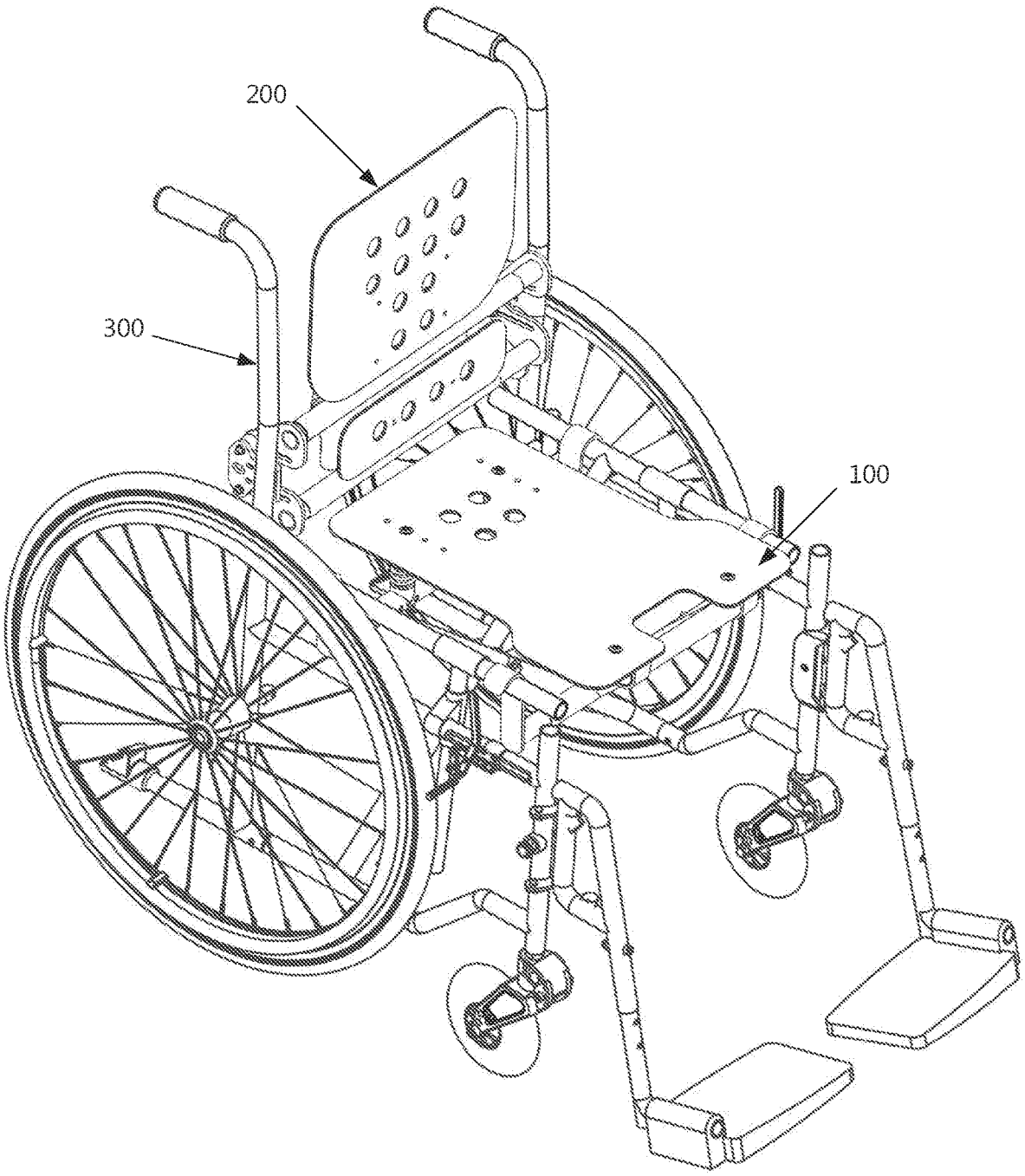
FIG. 8 is a front perspective view of the seating apparatus of FIG. 1 installed in a wheelchair chassis.
Figure 9:
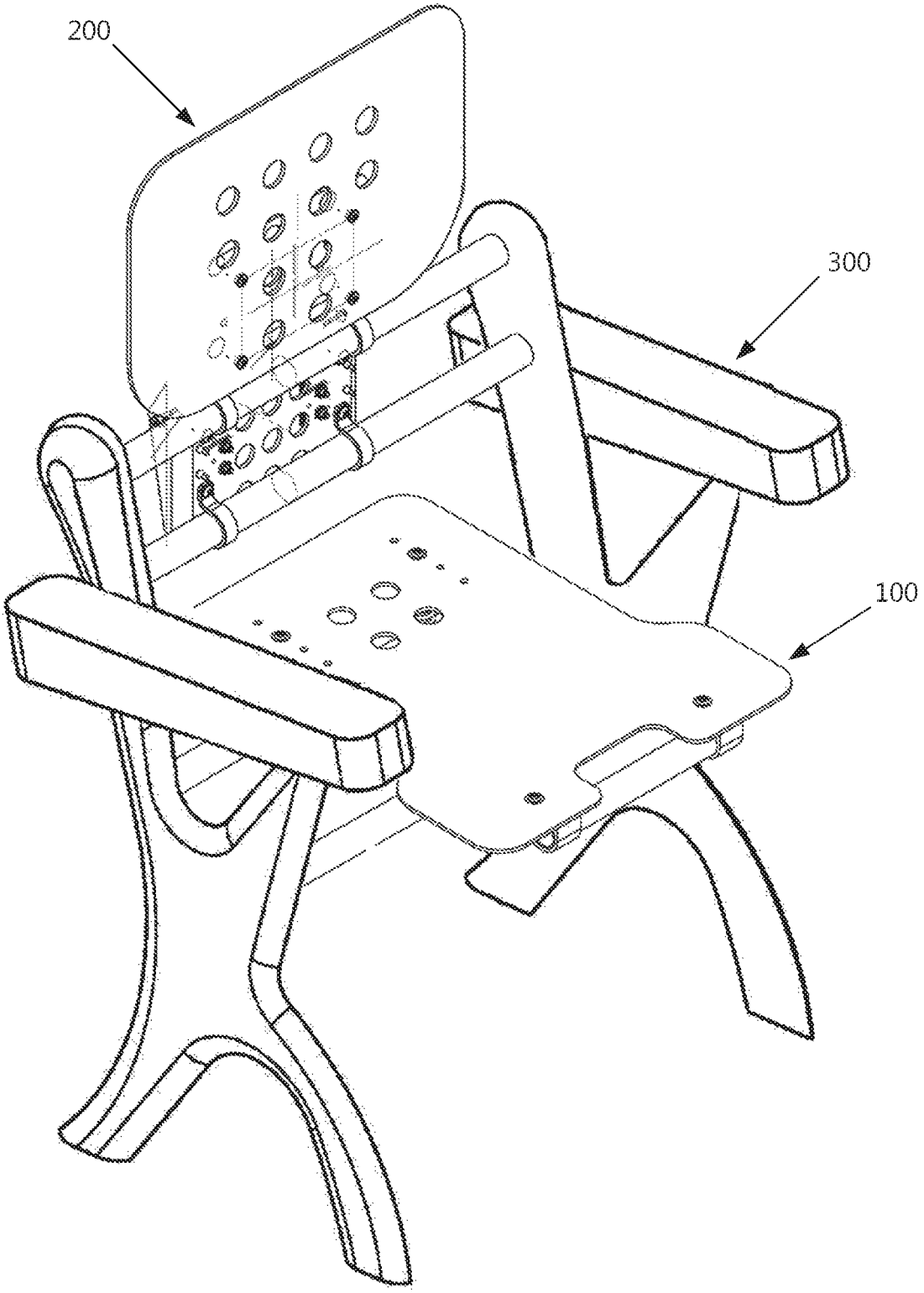
FIG. 9 is a front perspective view of the seating apparatus of FIG. 1 installed in a stadium or auditorium seating chassis.

The seat 100 includes a seat frame 102. The seat frame 102 includes at least one receiving rod 101 having open ends to receive penetrating rods 103 on each end. In preferred embodiments, the seat frame 102 has a first receiving rod 101 positioned near the front of the seat 100 and a second receiving rod 101 positioned near the rear of the seat 100. Penetrating rods 103 have a first cross-sectional dimension and receiving rod 101 has a second cross-sectional dimension larger than the first cross-sectional dimension such that receiving rod 101 is configured for telescoping reception of the penetrating rods 103. Thus, a user can adjust the width of the seat frame 102 to fit various sized seating chassis. Preferably, receiving rod 101 and penetrating rods 103 have cylindrical cross-sections, but the invention contemplates other sufficiently shaped rods, such as rectangular or hexagonal cross-sections. Penetrating rod 103 has attachment member 108 for securing the seat 100 to a seating chassis. Preferably, attachment member 108 is a J-hook or a similar bracket that permits the seat 100 to be removably secured to a seating chassis 300, as shown in FIG. 8. In preferred embodiments, the attachment members 108 are angled away from the seat frame 102 to permit easier attachment to the seating chassis 300, as depicted in FIG. 3. In some embodiments, the attachment members 108 are generally perpendicular to the seat frame 102. In some embodiments, the seat 100 is permanently fixed to a seating chassis 300, as shown in FIG. 9.

Figure 6:
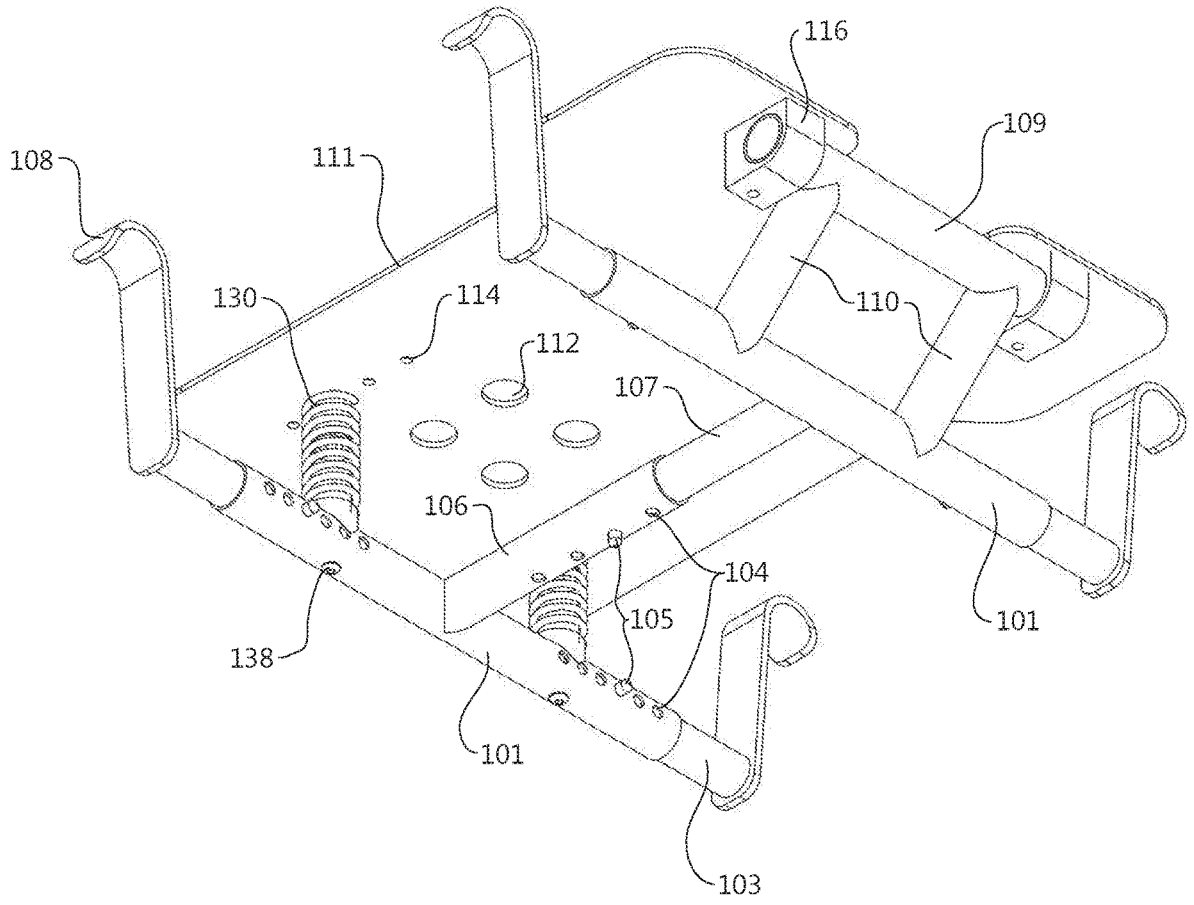
FIG. 6 is a bottom perspective view of the seat of FIG. 1.

In preferred embodiments, the seat frame 102 also includes at least one receiving rod 106 having an open end to receive penetrating rod 107. As seen in FIG. 6, receiving rod 106 is secured to one of the receiving rods 101 and penetrating rod 107 is secured to the other of the receiving rods 101. Penetrating rod 107 has a first cross-sectional dimension and receiving rod 106 has a second cross-sectional dimension larger than the first cross-sectional dimension such that receiving rod 106 is configured for telescoping reception of the penetrating rod 107. Thus, a user can adjust the length of the seat frame 102 to fit various sized seating chassis. Preferably, receiving rod 106 and penetrating rod 107 have cylindrical cross-sections, but the invention contemplates other sufficiently shaped rods, such as rectangular or hexagonal cross-sections.

In preferred embodiments, the seat frame components 101, 103, 106, and 107 use spring-biased detent mechanisms for preventing the frame components from inadvertent misalignment during adjustment of the seat frame 102. Preferably, receiving rods 101 and 106 include a plurality of detent holes 104 located near the open ends, and penetrating rods 103 and 107 include a spring-biased detent pin 105 located near the distal end. The detent holes 104 are configured to receive the detent pin 105 when the detent pin 105 is aligned with one of the plurality of detent holes 104. When the receiving rod 101/106 and penetrating rod 103/107 are adjusted relative to each other to align the detent pin 105 with a detent hole 104, the detent pin 105 springs into a locked position. A user can move the detent pin 105 back to the unlocked position by manually depressing the detent pin 105 against the spring bias, permitting the detent pint 105 to freely slide along an interior surface of receiving rod 101/106. In some embodiments, any other locking means known in the art are used to secure penetrating rods 103/107 to receiving rods 101/106. In other embodiments, no locking means are used.

The seat 100 also includes a seat support 111. Preferably the seat support 111 is formed of a rigid material, such as a molded composite material, has a contoured shape ergonomically designed to correspond to the human body, and has a plurality of ventilation holes 112. In some embodiments, the seat support 111 has a generally flat shape. In some embodiments, a seat pad constructed from a ventilated cushioning material is disposed on the seat support 111.

Preferably, the front end of seat support 111 is connected to the seat frame 102 through at least one fulcrum 116. In preferred embodiments, the front end of the seat support 111 is connected to the seat frame 102 through two fulcrums 116, as seen in the figures. Preferably, fulcrum 116 is a pivot bracket having a bore to receive an end of a pivot rod 109 of seat frame 102, as depicted in FIG. 6. Pivot rod 109 is connected to the first receiving rod 101 through at least one support rod 110. Preferably, pivot rod 109 runs generally parallel with a transverse horizontal axis of seat frame 102 such that seat support 111 pivots about that axis.

Figure 5:
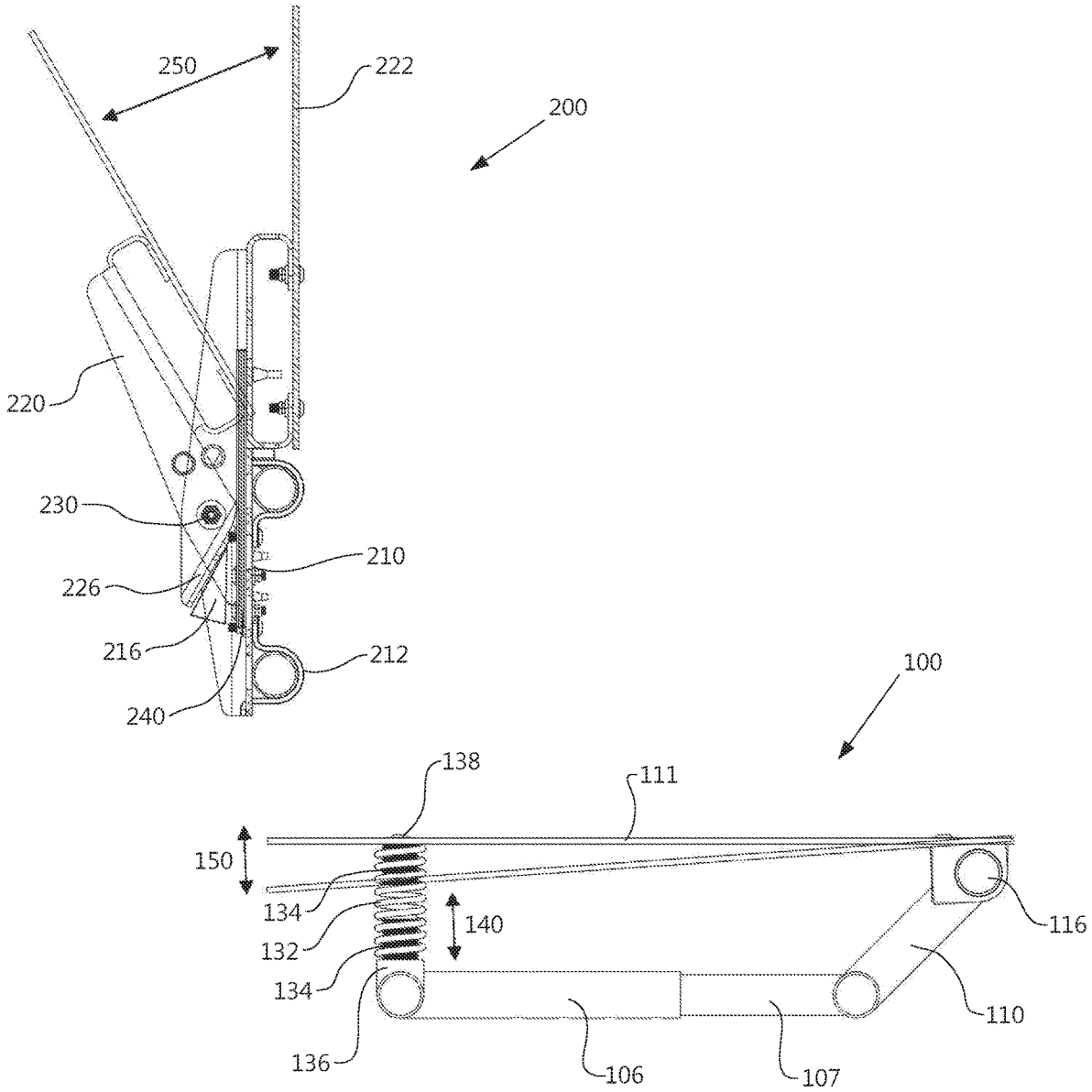
FIG. 5 is a side elevational view of the seating apparatus of FIG. 1 showing the flexibility of the seat and back support.

Preferably, the rear end of seat support 111 is connected to the seat frame 102 through at least one spring assembly 130. In preferred embodiments, spring assembly 130 includes a mechanical spring 132 surrounding well-nuts 134. As depicted in FIG. 5, a top well-nut 134 connects the spring assembly 130 to the seat support 111, and a bottom well-nut 134 connects the spring assembly 130 to the second receiving rod 101. The bottom well-nut 134 connects to a saddle washer 136, which has a relatively flat top and a bottom that contours to the shape of the second receiving rod 101. The well-nuts 134 are secured to the seat support 111 and the second receiving rod 101 by fasteners 138, such as bolts or screws. In some embodiments, the spring assembly 130 is encased in a bellows to protect the spring 132 from corrosion and to protect a user from being pinched by the spring 132. In some embodiments, spring assembly 130 is any other suitable spring system, such as a torsion spring or a mechanical shock absorber.

In preferred embodiments, the rear end of the seat support 111 is connected to the seat frame 102 through two spring assemblies 130, as seen in the figures. The relationship of the spring assemblies 130 to the fulcrums 116 determines the dynamic motion provided by the seat 100, such that the pivoting action is initiated across the transverse horizontal axis of the seat frame 102 and the seat support 111 moves bilaterally up, down, and side-to-side.

Preferably, the springs 132 are sized so as to normalize the seat support 111 in a position substantially parallel to the seat frame 102 when no force is applied to the seat 100. When force is applied to the seat support 111, the spring 132 compresses a distance 140, permitting the seat support 111 to pivot a corresponding angle 150, as shown in FIG. 5. In preferred embodiments, the seat support 111 pivots approximately 4 to 5 degrees from normal when a user is seated. In some embodiments, the seat support 111 pivots approximately 10 degrees from normal. The pivotal resistance of the seat support 111 can be adjusted for users having different weights by using springs with various spring constants or by tightening or loosening the well-nuts 134 to provide varying initial spring resistance.

In preferred embodiments, the seat support includes a plurality of fastening holes 114 for various placements of spring assemblies 130 along the length of the seat support 111. The various placements of the spring assemblies 130 affects the seat impact on a user, the distribution of the user's weight, and the activation of the user's pelvis and hip joints.

The backrest 200 includes a back frame 202. The back frame 202 includes at least one receiving rod or bar 201 having open ends to receive penetrating rods 203 on each end. In preferred embodiments, the back frame 202 has two parallel receiving rods/bars 201 stacked vertically, as shown in the figures. Penetrating rods 203 have a first cross-sectional dimension and receiving rod 201 has a second cross-sectional dimension larger than the first cross-sectional dimension such that receiving rod 201 is configured for telescoping reception of the penetrating rods 203. Thus, a user can adjust the width of the back frame 202 to fit various sized seating chassis. Preferably, receiving rod 201 and penetrating rods 203 have cylindrical cross-sections, but the invention contemplates other sufficiently shaped rods, such as rectangular or hexagonal cross-sections or other cross section shapes. In some embodiments, the penetrating rods 203 are secured to the receiving rod 201 by a spring-biased detent mechanism, as described above. In some embodiments, any other locking means known in the art are used to secure penetrating rods 203 to the receiving rod 201. In other embodiments, no locking means are used.

In preferred embodiments, penetrating rods 203 are connected to attachment brackets 206. Attachment brackets 206 have a plurality of laterally extending slots 208 through which bolts, or other mechanical fasteners, connect attachment members 204 to the attachment brackets 206. Preferably, the laterally extending slots 208 permit a user to adjust the depth of the back frame 202. In preferred embodiments, attachment member 204 is a clamp or a similar mechanism that permits the backrest 200 to be removeably secured to a seating chassis 300, as shown in FIG. 8. The height of the backrest 200 is adjustable by loosening the attachment members 204, sliding the backrest 200 up or down along the seating chassis 300, and retightening the attachment members 204. In some embodiments, the backrest 200 is permanently fixed to a seating chassis 300, as shown in FIG. 9.

The backrest 200 also includes a lumbar support 210. Preferably, the lumbar support 210 is secured to the back frame 202 by loop clamps 212 that contour to the shape of the receiving rods 201, as depicted in FIG. 1. In preferred embodiments, the lumbar support 210 is formed of a rigid material, such as a molded composite material, has a contoured shape ergonomically designed to correspond to the human body, and has a plurality of ventilation holes 214. In some embodiments, the lumbar support 210 has a generally flat shape. In some embodiments, a lumbar pad constructed from a ventilated cushioning material is disposed on the lumbar support 210.

The backrest 200 further includes a back support 220 having a back support surface 222. Preferably the back support surface 222 is formed of a rigid material, such as a molded composite material, has a contoured shape ergonomically designed to correspond to the human body, and has a plurality of ventilation holes 224. In some embodiments, the back support surface 222 has a generally flat shape. In some embodiments, a back pad constructed from a ventilated cushioning material is disposed on the back support surface 222.

Figure 7:
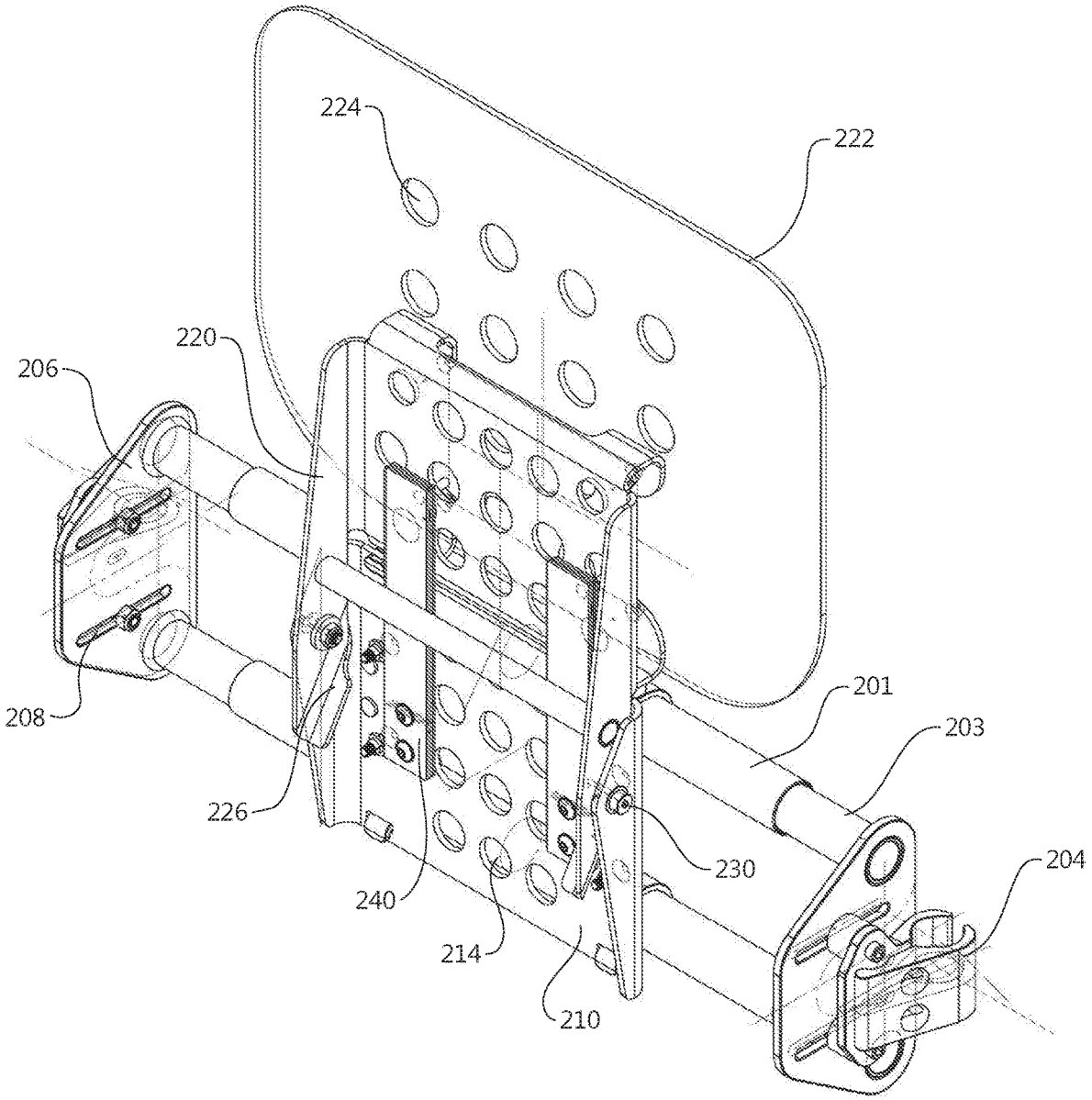
FIG. 7 is a rear perspective view of the back support of FIG. 1.

Preferably, the back support 220 is connected to the lumbar support 210 through at least one hinge 230. In preferred embodiments, the back support 220 is connected to the lumbar support 210 through two hinges 230, as seen in FIG. 7. Preferably, hinge 230 is a bolt configured to permit the back support 220 and the lumbar support 210 to rotate relative to each other, as depicted in FIG. 5. Preferably, hinge 230 runs generally parallel with a transverse horizontal axis of back frame 202 such that back support 220 pivots about that axis.

The backrest 200 also includes at least one resilient pivotal member 240 positioned along adjacent surfaces of the lumbar support 210 and the back support 220 such that the back support 220 is capable of resilient pivoting about the transverse horizontal axis of the back frame 202. In some embodiments, the backrest 200 includes two resilient pivotal members 240. In preferred embodiments, the resilient pivotal members 240 are leaf springs, as shown in FIG. 7. In some embodiments, the resilient pivotal members 240 are torsion springs, or any other suitable alternatives. Preferably, the resilient pivotal members 240 are secured at one end to the lumbar support 210, with the other end free to flex when the back support 220 pivot about the hinges 230.

When force is applied to the back support surface 222, the back support 220 pivots an angle 250 from the normal vertical position, as depicted in FIG. 5. In preferred embodiments, the back support 220 pivots up to approximately 30 degrees from normal so that the user's center of gravity remains over the base of the seating chassis. In some embodiments, the back support 220 pivots up to approximately 50 degrees from normal. The pivotal resistance of the resilient pivotal member can be adjusted by using leaf springs with various spring constants or by adding or removing leaf spring layers to provide varying initial spring resistance.

In some embodiments, the back support 220 also includes at least one pivot arm 226. Preferably, pivot arm 226 is generally located below the hinge 230 and is angled away from the lumbar support 210, as shown in FIG. 7. The pivot arm 226 is configured to limit the pivot angle 250 of the back support 220 and serve as a postural support for a user by interacting with the lumbar support 210 and resisting further pivoting of the back support 220.

In preferred embodiments, the lumbar support also includes at least one pivot block 216. Preferably, the pivot block 216 is positioned such that it interacts with the pivot arm 226 when the back support 220 pivots the maximum pivot angle 250, as depicted in FIG. 5. Thus, the pivot block 216 is configured to further limit the pivot angle 250 of the back support 220 by interacting with the pivot arm 226 and resisting further pivoting of the back support 220.

Although the invention has been described with reference to a particular arrangement of parts, features, and the like, these are not intended to exhaust all possible arrangements or features, and indeed many other modifications are variations will be ascertainable to those of skill in the art.

What is claimed is:

1. An ergonomically designed seating apparatus comprising:

a seat comprising:

a seat frame adapted to be secured to a chassis;

a seat support pivotally connected to the seat frame such that the seat support is capable of pivotal tilting about a first transverse horizontal axis relative to the seat frame;

at least one first resilient member positioned between the seat frame and the seat support permitting resilient relative pivotal tilting therebetween; and a backrest comprising:

a back frame adapted to be secured to the chassis, the back frame comprising two parallel bars;

a lumbar support connected to the back frame at each of the two parallel bars;

a back support pivotally connected to the lumbar support such that the back support is capable of pivotal tilting about a second transverse horizontal axis relative to the back frame, the two parallel bars aligning parallel to and on either side of the second transverse horizontal axis such that the second transverse horizontal axis is between the two parallel bars and said back support extends above the two parallel bars;

at least one second resilient member positioned along surfaces of the lumbar support and the back support permitting resilient relative pivotal tilting therebetween;

said back frame and said seat frame connected to and removable from a wheelchair frame having at least three wheels, wherein a position of the second transverse horizontal axis is adjustable relative to the wheelchair frame from front to back.

2. The seating apparatus of claim 1, wherein the seat frame comprises at least one telescoping member arranged such that the seat frame is size-adjustable in at least one dimension.

3. The seating apparatus of claim 1, wherein the seat frame comprises a plurality of telescoping members arranged such that the seat frame is size-adjustable in at least one dimension.

4. The seating apparatus of claim 1, wherein the back frame comprises at least one telescoping member connected to each of the two parallel bars and arranged such that the back frame is size-adjustable in at least one dimension.

5. The seating apparatus of claim 1, wherein the back frame comprises a plurality of telescoping members connected to each of the two parallel bars and arranged such that the back frame is size-adjustable in at least one dimension.

6. The seating apparatus of claim 1, wherein the back support comprises at least one pivot arm extending below the second transverse horizontal axis configured to limit the pivotal range of motion of the back support.

7. The seating apparatus of claim 6, wherein the lumbar support comprises at least one pivot block configured to interact with the at least one pivot arm.

8. The seating apparatus of claim 1, wherein each of the seat support, the lumbar support, and the back support have a contoured shape ergonomically designed to correspond to the human body, and have a plurality of ventilation holes.

9. An ergonomically designed seating apparatus comprising:

a seat comprising:

a seat frame adapted to be secured to a chassis;

a seat support pivotally connected to the seat frame such that the seat support is capable of pivotal tilting about a first transverse horizontal axis relative to the seat frame;

at least one first resilient member positioned between the seat frame and the seat support permitting resilient relative pivotal tilting therebetween; and a backrest comprising:

a back frame adapted to be secured to the chassis;

a lumbar support connected to the back frame;

a back support pivotally connected to the lumbar support such that the back support is capable of pivotal tilting about a second transverse horizontal axis relative to the back frame;

at least one second resilient member positioned along surfaces of the lumbar support and the back support permitting resilient relative pivotal tilting therebetween;

at least one pivot arm connected to the back support, the at least one pivot arm configured to limit the pivotal range of motion of the back support; and at least one pivot block connected to the lumbar support, the at least one pivot block configured to interact with the at least one pivot arm.

10. The seating apparatus of claim 9, wherein the seat frame comprises at least one telescoping member arranged such that the seat frame is size-adjustable in at least one dimension.

11. The seating apparatus of claim 9, wherein the back frame comprises at least one telescoping member arranged such that the back frame is size-adjustable in at least one dimension.

12. The seating apparatus of claim 9, wherein each of the seat support, the lumbar support, and the back support have a contoured shape ergonomically designed to correspond to the human body, and have a plurality of ventilation holes.

13. A wheelchair comprising:

a wheelchair chassis;

a seat comprising:

a seat frame adapted to be secured to the wheelchair chassis;

a seat support pivotally connected to the seat frame such that the seat support is capable of pivotal tilting about a first transverse horizontal axis relative to the seat frame;

at least one first resilient member positioned between the seat frame and the seat support permitting resilient relative pivotal tilting therebetween; and a backrest comprising:

a back frame adapted to be secured to the wheelchair chassis;

a lumbar support connected to the back frame the lumbar support supporting a lumbar surface configured to support a user's lumbar region;

a back support pivotally connected to the lumbar support such that the back support is capable of pivotal tilting about a second transverse horizontal axis relative to the back frame wherein the back support supports a back surface configured to engage the user's back region;

at least one second resilient member positioned along surfaces of the lumbar support and the back support permitting resilient relative pivotal tilting therebetween wherein the resilient relative pivotal tilting allows the lumbar surface and back surface to tilt relative each other.

14. The wheelchair of claim 13, wherein the seat frame comprises at least one telescoping member arranged such that the seat frame is size-adjustable in at least one dimension.

15. The wheelchair of claim 13, wherein the seat frame comprises a plurality of telescoping members arranged such that the seat frame is size-adjustable in at least one dimension.

16. The wheelchair of claim 13, wherein the back frame comprises at least one telescoping member arranged such that the back frame is size-adjustable in at least one dimension.

17. The wheelchair of claim 13, wherein the back frame comprises a plurality of telescoping members arranged such that the back frame is size-adjustable in at least one dimension.

18. The wheelchair of claim 13, wherein the back support comprises at least one pivot arm configured to limit the pivotal range of motion of the back support.

19. The wheelchair of claim 18, wherein the lumbar support comprises at least one pivot block configured to interact with the at least one pivot arm.

20. The wheelchair of claim 13, wherein each of the seat support, the lumbar support, and the back support have a contoured shape ergonomically designed to correspond to the human body, and have a plurality of ventilation holes.

* * * * *